United States Patent [19]

Roderick et al.

[11] 4,022,415

[45] May 10, 1977

[54] SUPPORT FOR TIE BACK AND RETURN OF DRAPERY

[75] Inventors: Zackary A. Roderick, Bethel Island; Robert G. Ross, Fremont, both of Calif.

[73] Assignee: Galgon Industries, Inc., Fremont, Calif.

[22] Filed: Sept. 2, 1975

[21] Appl. No.: 609,595

[52] U.S. Cl. ..... 248/298; 160/349 D; 24/73 CH

[51] Int. Cl.[2] ..... A47H 19/00

[58] Field of Search ..... 24/73 CH, 73 MC, 73 NM, 24/73 SM; 160/349, 394–397, 330, DIG. 7, 40; 248/477, 479, 300, 298

[56] References Cited

UNITED STATES PATENTS

| | | | |
|---|---|---|---|
| 1,955,152 | 4/1934 | Simmons | 160/349 D |
| 2,337,950 | 12/1943 | Werner et al. | 160/349 D |
| 2,757,890 | 8/1956 | Sutton et al. | 248/496 |
| 2,773,546 | 12/1956 | Doty | 160/349 D |
| 3,011,748 | 12/1961 | Breuer | 248/265 |
| 3,420,289 | 1/1969 | Bejarano | 248/298 |
| 3,791,709 | 2/1974 | Cross | 248/496 |
| 3,866,659 | 2/1975 | Kaminski | 160/349 D |
| D162,122 | 2/1951 | Broeren | 248/300 X |

FOREIGN PATENTS OR APPLICATIONS

| | | | |
|---|---|---|---|
| 1,177,790 | 3/1959 | Germany | 248/287 |

*Primary Examiner*—Kenneth Downey
*Attorney, Agent, or Firm*—Flehr, Hohbach, Test

[57] ABSTRACT

A support is disclosed for holding the tie back and return of a drapery along a wall or other structure. The support includes a base and extension arm which are formed with corrugations defining elongate ribs and grooves adapted to interfit both for guiding the arm for adjustable positioning along the base and also for preventing twisting of the arm relative to the base. Punched-out projections are formed in the base for securing opposite ends of the tie back. Screw fasteners are mounted through elongate slots formed in the arm to accommodate variable arm positions. The screw fasteners self-form threads as they are screwed into extruded shoulders of openings in the base. The arm and base are adapted to be mounted in inverted position for use on either side of the drapery. The extension arm is also adapted to be alternately mounted either in alignment with the base, or offset below the base where the tie back is to hang at an angle.

1 Claim, 7 Drawing Figures

SUPPORT FOR TIE BACK AND RETURN OF DRAPERY

BACKGROUND OF THE INVENTION

This invention relates in general to devices for supporting a drapery along a wall or other structure.

It is commonplace to hang a drapery along a window opening or wall with the vertically extending folds gathered on each side and held back in a decorative fashion by means of a tie back. Such tie backs can be of a rigid material such as wood or metal or of a flexible material such a material matching the drapery. In many cases it is desirable to support the return portion of the drapery from the walls so that the return folds are not crushed against the wall. Among the prior art devices which have been employed for this purpose are the drapery holder disclosed in U. S. Pat. No. 3,420,289. In this patent the tie back and drapery return are supported by a bracket which is affixed at one end to the wall and has an arcuate outer end. In one embodiment of the patent an adjustable bracket is provided in which the inner and outer sections are bolted onto an intermediate plate.

Conventional holders of the type described have a number of limitations and drawbacks. It is a difficult task to mount the holder on the wall and attempt to adjust the intermediate plate and outer section in proper position. The outer section and plate tend to slip out of position when the fastening bolts are loose and it is difficult to hold the various parts in proper position when tightening the bolts. It is furthermore difficult to properly assemble the bracket so that its outer section is offset below the inner section for supporting the tie back at an inclined angle. The assembling procedure is made even more difficult by the requirement of threading and tightening the nuts on the various bolts.

The drapery tie backs are conventionally secured to the prior art holders by means of pin hooks which engage eyelets attached to the ends of the tie back. The hooks are slipped through openings formed through the inner section of the bracket. However, there is no provision in such holders for securing the inner portion of the tie back onto the holder so that there is sufficient room for a sheer curtain between the return and wall. It would be desirable to provide a support which would simplify assembly and mounting of the tie back and also permit alternate use of the support for a combination drapery and sheer curtain arrangement.

OBJECTS AND SUMMARY OF THE INVENTION

It is a general object of the invention to provide a new and improved drapery tie back and return support which is simple and inexpensive in design and construction, which is convenient to assemble and mount on a wall, and which can be easily adjusted to the desired length for supporting the drapery.

Another object is to provide a drapery support of the type described in which an outer extension arm is guided by means of an innerfitting groove and rib arrangement to facilitate assembly and adjustment of the support. The guide means prevents twisting of the parts while the fasteners are slightly loose to permit extension and retraction of the arm to the desired position.

Another object is to provide a drapery support of the type described in which the rib and groove arrangement facilitates assembly of the support in alternate configurations, one of which mounts the extension arm in horizontal alignment with the base and the other of which mounts the arm offset below the base for supporting the tie back at an inclined angle.

Another object is to provide a drapery support of the type described in which the extension arm is secured to the base by thread-forming screws which engage into extruded shoulders of openings formed in the support so that nuts are not required to assembly the support.

Another object is to provide a drapery support of the type described which facilitates the mounting of the ends of the tie back onto the support without the requirement of drapery pin hooks.

Another object is to provide a drapery support of the type described which is versatile in application and can be mounted in inverted position without modification for use on either side of the drapery.

Another object is to provide a drapery support of the type described which provides means for attaching the inner end of the tie back to the support in a manner which permits a sheer curtain to be hung between the drapery return and the adjacent wall.

The invention in summary comprises a support which includes a base having a mounting flange adapted to be secured to the wall or structure along which the drapery hangs. An extension arm having an arcuate outer end is mounted on the outer end of the base. Cooperative rib and groove means are formed along the surfaces of the base and arm whereby the arm is guided for adjustable movement relative to the base so that the return can be supported at the desired distance from the wall. Fastener means comprising thread-forming screws are mounted through slots formed in one of the members and into engagement with extruded shoulders of openings formed in the other member. When tightly locked the fasteners fixedly hold the arm to the base, and when loosened the fasteners permit longitudinal adjustment of the extension arm. Projections which are punched-out in the base permit attachment of eyelets for securing opposite ends of the tie back. The rib and groove means permit the support to be assembled in alternate configurations with either the extension arm projecting horizontally from the base or with the arm extending in a direction offset below the base where it supports the tie back at a downwardly inclined angle. A projection is also formed in the base for alternately attaching the inner end of the tie back so that the drapery return is held spaced from the wall to permit a sheer curtain to be disposed between the return and wall.

The foregoing and additional objects and features of the invention will become apparent from following description in which the preferred embodiments have been set forth in detail in conjunction with the accompanying drawings.

BRIEF DESCRIPTION OF THE PREFERRED EMBODIMENTS

Figure 1:
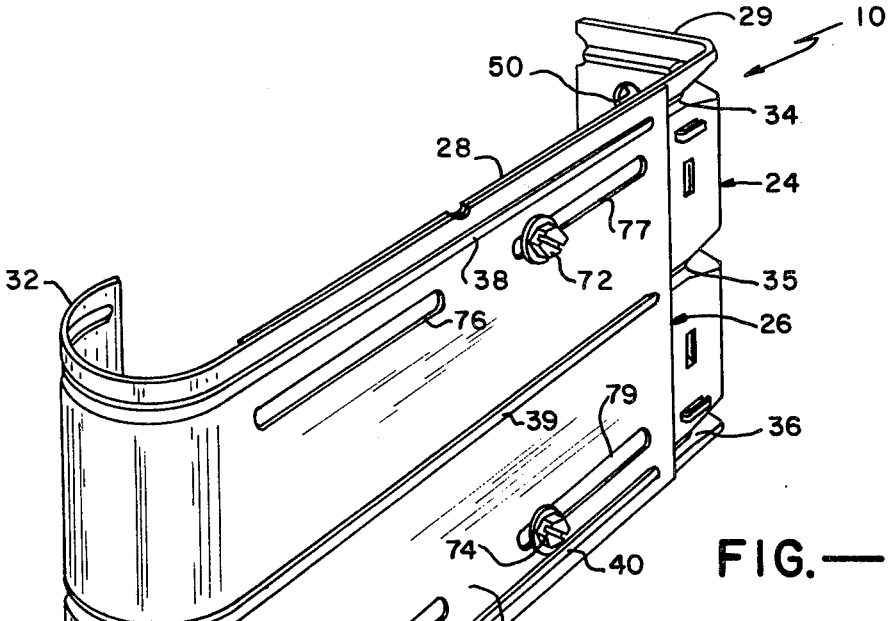
FIG. 1 is a perspective view of a drapery tie back support of the invention shown assembled in one configuration.
Figure 3:
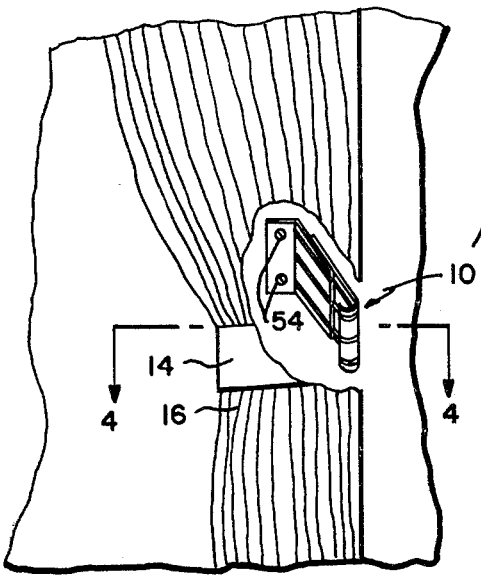
FIG. 3 is a perspective cut-way view showing the support of FIG. 1 mounted on a wall along the side of a drapery.
Figure 4:
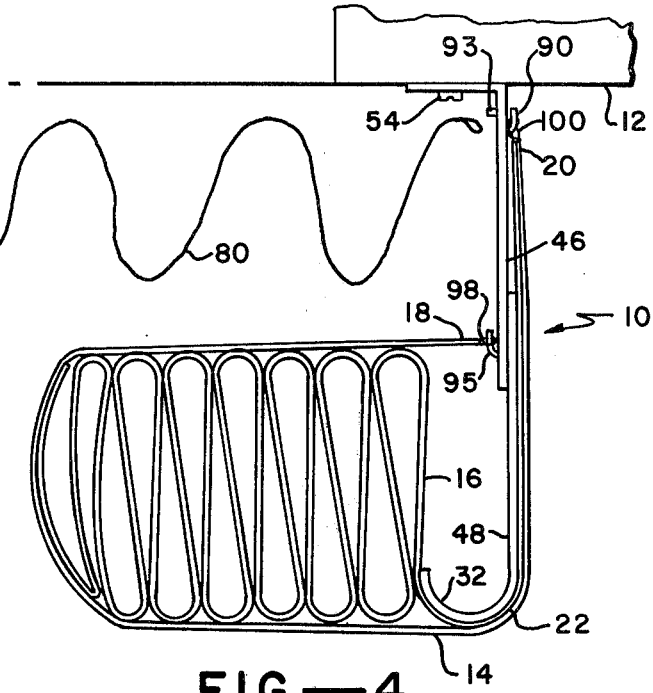
FIG. 4 is a cross-sectional view taken along the line 4—4 of FIG. 3.

In the drawings FIG. 1 illustrates generally at 10 a drapery tie back support made in accordance with the invention. FIGS. 3 and 4 illustrate the support 10 when mounted on a wall 12 or other structure for supporting a tie back 14 used in conjunction with drapery 16. Drapery 16 can be of any conventional decorative material and is hung by a suitable traverse rod or other support along a window opening, door frame or the like. The drapery hangs down in a number of folds or convolutions having a dimension, known as the return, which extends toward the wall or structure. The returns on opposite sides of the drapery are each gathered and drawn to the side by tie backs which are comprised of a suitable flexible material, such as the decorative material matching the drapery and which can include an inner lining of a suitable material such as buckram. The two ends 18 and 20 of the tie back as well as the outer most fold 22 of the drapery are mounted on support 10 in a manner to be described.

Support 10 includes a base 24 adapted to be mounted on and extend outwardly from the wall together with an extension arm 26 which is mounted on the distal end of the base. Base 24 is formed with a flat panel 28 which is integral with and extends at right angles from a mounting flange 29. Extension arm 26 is also formed with a flat panel 30 terminating at its distal end with an inwardly turned arcuate surface 32 around which the outermost fold of the return is supported in the manner illustrated in FIG. 4. The base and extension arm both are made of a suitable lightweight rigid material, such as aluminum, which facilitates low cost manufacture of the parts by a suitable stamping operation or the like.

Cooperative guide means are formed on both the base and extension arm, and the guide means comprises three horizontally spaced-apart parallel corrugations 34, 35 and 36 formed in the base together with three parallel corrugations 38, 39 and 40 formed in the arm at horizontal spacing equal to the spacing between the corrugations in the base. The corrugations can be formed by a suitable die during the stamping operation whereby each corrugation forms a rib or ridge 42 which extends above one surface of the base or arm as well as a groove 44 which extends along the opposite surface. In the illustrated embodiment the three corrugations on the base 24 are formed with the grooves on the outer surface 46 while the complimentary corrugations on the arm 26 are formed with the ribs on the inner surface 48 so that these ribs seat within respective grooves with the arm mounted against the base in the manner shown in FIG. 1. The corrugations could be formed in reverse from that illustrated such that the ribs project along the outer surface of the base while the grooves are formed along the inner surface of the arm. The corrugations function to stiffen the base and arm and increase their resistance to bending moments, while at the same time the cooperative seating engagement between the ribs and grooves provide a positive lock between the base and arm to preclude twisting or displacement when these parts are mounted together. Furthermore, the cooperative engagement provides a guide track which permits the arm to be moved in and out to a selected position relative to the base without being separated therefrom when the fasteners are untightened sufficient to unlock the base from the arm but yet maintain iterengagement of the ribs and grooves.

Figure 6:
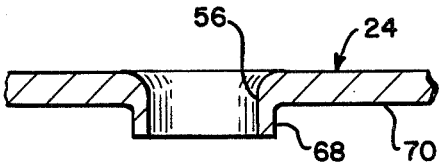
FIG. 6 is a fragmentary sectional view taken along the line 6—6 in FIG. 5.

Openings are formed in the base and arm both for assembling these parts together and for mounting the support to the wall. A pair of vertically aligned circular openings 50 and 52 are formed through flange 29 for receiving suitable screw fasteners 54 which mount the flange to the wall. A plurality of circular openings 56–65 are provided in panel 28 of the base and each such opening is formed by a suitable stamping die to produce an annular shoulder 68 which projects a short distance beyond the inner surface 70 of the base, as shown in FIG. 6 for the typical opening 56. The fasteners used to assemble the arm onto the base are suitable thread-forming screws 72, 74 which when screwed into the opening, automatically form threads on the inner diameter of each shoulder so that the fasteners are tightly engaged without the need for nuts.

In the illustrated embodiment the openings 56–58 and 63–65 are formed in a pair of horizontally spaced apart top and bottom rows for purposes of mounted the extension arm with its longitudinal axis in alignment with the longitudinal axis of the base, as shown in FIG. 1. In this configuration the support holds the tie back level. In such case a pair of the fasteners would be screwed into selected holes in the top and bottom rows, depending upon the longitudinal position at which the arm is to be mounted. The pairs of openings 59, 60 and 61, 62 are formed in two spaced apart inner rows which are positioned between the outer rows of openings. The openings 61, 62 in the lower row are adapted to receive fasteners for mounting the arm offset below the base in the manner illustrated in FIG. 2. In this configuration the ribs of corrugations 38 and 39 are seated with the grooves of corrugations 35 and 36 on the base so that the tie back is held at a downwardly inclined angle when on the right hand side of the drapery. Alternatively, the upper row of openings 59, 60 are adapted to receive the fasteners when the support is inverted with the ribs of corrugations 39 and 49 seated in the grooves of corrugations 34 and 35 on the base so that the tie back is held at an inclined angle on the left hand side of the drapery.

Pairs of elongate slots 76, 77 and 78, 79 are formed in the arm along two parallel rows which are spaced apart a distance equal to the spacing between the outer rows of openings 56–58 and 63–65 in the base. The slots are sized in length sufficient to register with at least one set of openings in the two rows along the full length of adjusting movement of the arm so that a range of adjustment positions is provided for the support. Thus, in the fully extended position of FIG. 4 where the support holds the drapery return away from the wall so that a sheer curtain 80 can be hung between the return and drapery, the slots 77 and 79 are in register with the outer openings 58, 65 through which the fasteners are installed to lock the parts together. In the fully retracted position as illustrated in FIG. 1 the slots are in register with both the inner and outer openings of the two rows, either of which can receive the fasteners, The middle openings 57 and 64 are adapted to receive the fasteners at intermediate arm positions. While it is preferred that the slots be formed in the arm so that the ends of the fasteners project inwardly away from the drapery, the invention contemplates that the slots could be formed in the base with the corresponding openings being formed in the arm.

A pair of notches 82, 84 are formed in the top and bottom edges of the arm on a line between the pairs of slots, and a similar pair of notches 86, 88 are formed in the top and bottom edges of the base on a line between the openings 56 and 57. The notches provide fiducial marks by which the user can with a suitable tool cut off the outer distal end of the base and the inner proximal end of the arm where it is desirable to have the support extend only a short distance from the wall. In such case the outer pair of slots 76 and 78 would register with the inner openings 56, 63 in the base for receiving the fasteners which mount the two parts together. With the ends cut off, the outer surface of the arm could alternately be mounted against the inner surface 70 of the base with the ribs 42 of the base corrugations seated in the grooves of the arm corrugations.

Figure 5:
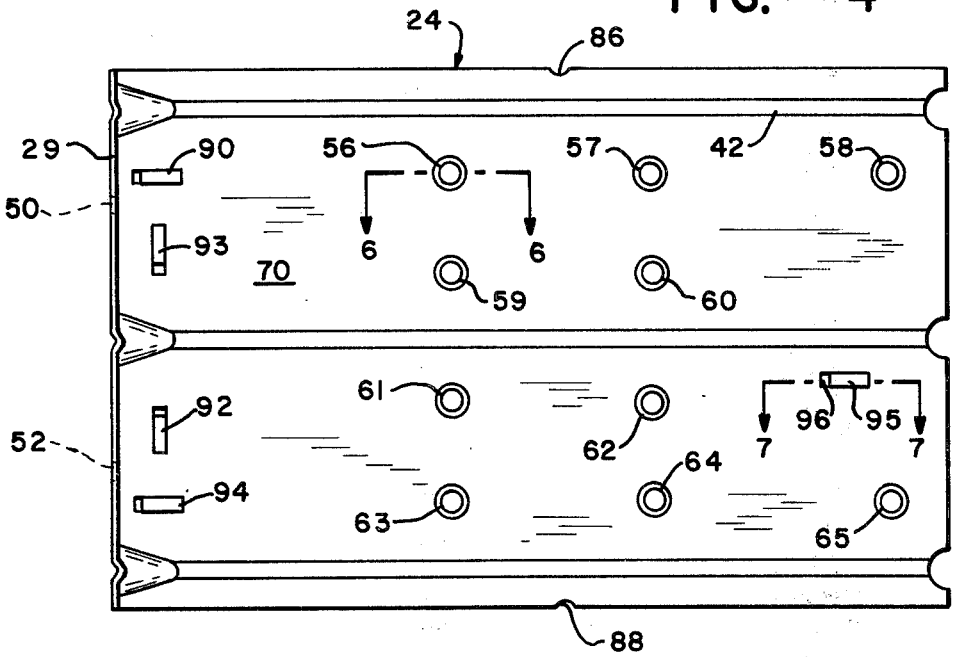
FIG. 5 is a side elevational view of the support base.
Figure 7:
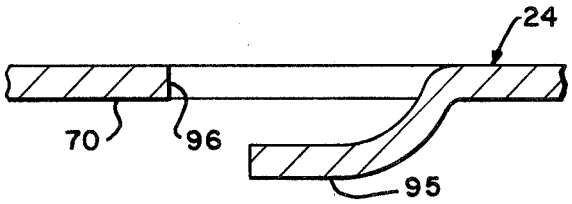
FIG. 7 is a fragmentary sectional view taken along the line 7—7 of FIG. 5.

Hook projection means is provided for attaching the ends of the tie back to the support. The hook projection means includes a plurality of projections 90–95 which are punched outwardly from the base by a suitable die during the stamping operation. As shown in FIGS. 5 and 7 the typical projection 95 at the distal end of the base is circumscribed by a generally U-shaped opening 96 and is disposed into a plane spaced from the inner surface 70 of the base. Projection 95 extends in a direction toward mounting flange 29 so that it can receive a suitable eyelet 98 or other fastener attached to the inner end of the tie back, as shown in FIG. 4, where the drapery return is supported away from the wall to permit hanging of the sheer curtain 80.

The pair of horizontal projections 90 and 94 are formed in the upper and lower margins of the proximal end of the base. These projections are disposed outwardly of the outer surface of the base and extend in a direction toward the wall, as illustrated in FIG. 4, for attaching the eyelet 100 or other fastener secured to the outer end of the tie back. The upper projection 90 would typically be used to attach an eyelet on outer end of the tie back when the support is installed on the right-hand side of the drapery, and the other projection 94 would be used to attach an eyelet on the outer end of the tie back when the support is inverted and installed on the left-hand side of the drapery.

The pair of vertically extending projections 92 and 93 are formed in the proximal end of the base between the horizontal projections and are disposed inwardly of the inner base surface 70. The lower projection points 92 in an upward direction and is adapted for attaching the eyelet 98 on the inner end of the tie back where a sheer curtain is not used. The other projection 13 points in an opposite direction and is adapted to attach the eyelet on the inner end of the tie back where the support is inverted and mounted on the left-hand side of the drapery and where a sheer curtain is not used.

Figure 2:
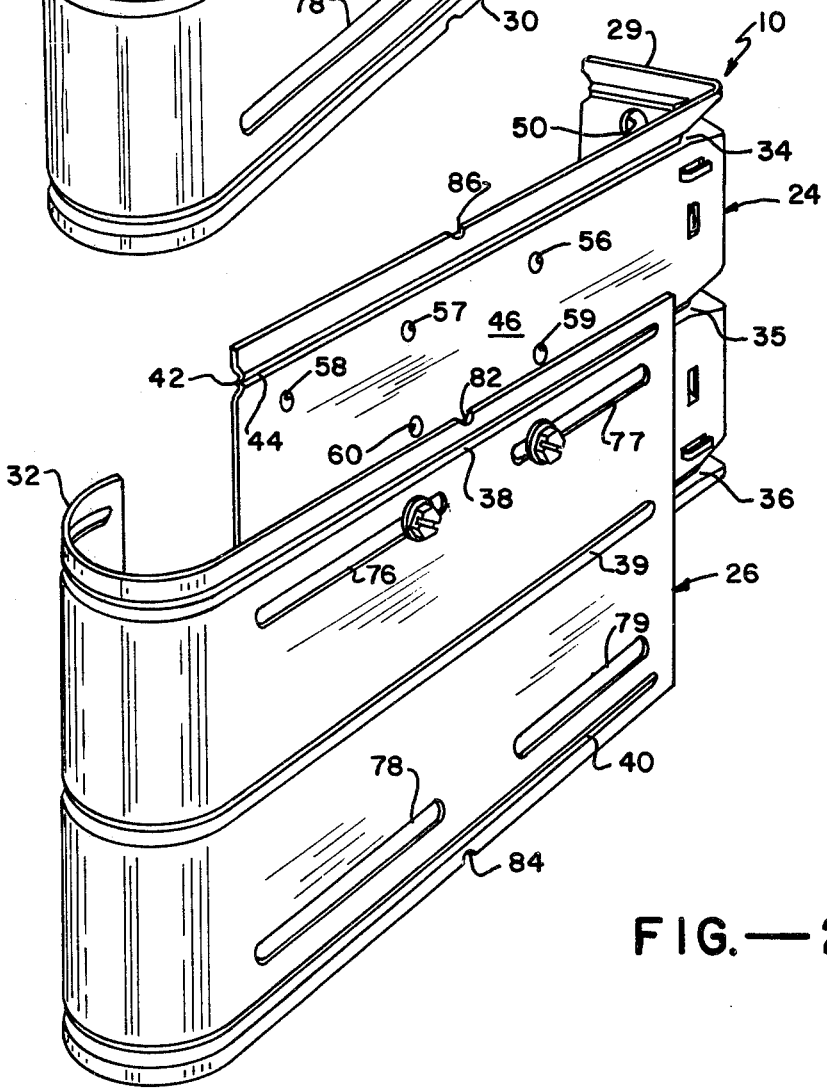
FIG. 2 is a perspective view of the support of FIG. 1 shown assembled in another configuration.

The use and operation of the invention is as follows. A pair of the support bases 24 of identical construction are mounted on the wall at opposite sides of the drapery at the desired elevation where the tie back is to be supported. The right-hand base is mounted by a pair of screw fasteners through the openings 50, 52 with the flange 29 pointed inwardly, while the other base is similarly mounted to the wall on the left-hand side of the drapery but inverted with its flange pointed inwardly. The extension arms 26 are then mounted against the outer surfaces of each base with the arcuate ends 32 of each arm pointed inwardly toward the center of the drapery. Where the tie backs are to be supported horizontally the three ribs of each arm are seated within the corresponding three grooves of the base, as illustrated in FIG. 1. Two thread-forming screw fasteners 72, 74 are placed through the upper and lower slots 77, 79 and screwed into the openings which are in register with the slots, depending upon the desired extent to which the arm is to project from the wall. Where the tie back is to be supported at a downwardly inclined angle the upper and middle ribs of the arm are seated respectively in the middle and lower grooves of the base, as illustrated in FIG. 2. A pair of the thread-forming fasteners are then inserted through the upper pair of slots 76, 77 and screwed into the pair of openings 61, 62 formed in the base immediately below the center groove.

The screw fasteners are first turned down to a point at which they loosely hold the extension arms against the base members with the ribs seated in the groove to a depth which is sufficient to prevent the arms from twisting or turning down with respect to the base. The arms are then moved back and forth along the base with the ribs of the arms being guided in the grooves. When the arms have reached the desired position the screws are tightly turned down to lock each arm against the base. It will be noted that the assembly of the arm onto the base as well as its adjustable positioning can be rapidly accomlished with a minimum of difficulty because it is not necessary for the user to place nuts on the ends of the fasteners, a task which can be unwieldy where the support may be mounted at a high elevation.

The return folds of a side of the drapery are gathered and pulled to one side with the tie back 14 being partially wrapped around the return. The side margin of the outer fold 22 of the drape is then wrapped around the arcuate surface 32 and placed alongside the outer surfaces of the extension arm and base, with the outer end 20 of the tie back then being wrapped around this portion of the drapery and the eyelet 100 hooked into the uppermost projection 90. The eyelet 98 attached to the inner end of the tie back is then brought back and hooked onto the upwardly directed projection 92. The return folds on the left-hand side of the drapery are gathered and secured to the opposite support with the eyelets on the end of the tie back being secured to the alternate set of horizontal and vertical projections 94, 93. As desired all of the projections may then be bent inwardly by a suitable tool such as a screw driver so that the eyelets are locked in place.

Where it is desired to support the drapery in combination with a sheer curtain the arm 26 is assembled in the extended position shown in FIG. 4. The eyelet 98 on the inner end of the tie back is then brought back and attached to the inwardly directed projection 95 so that the return is supported in spaced relationship from the wall. The sheer curtain 80 can then be supported on its traverse rod so as to freely hang down in the space between the return and wall. The projection 95 can also be bent in by a suitable tool to lock the eyelet in place.

While the foregoing embodiments are present considered to be preferred it is understood that numerous variations and modifications may be made therein by those skilled in the art and it is intended to cover in the appended claims all such variations and modifications as fall within the true spirit and scope of the invention.

What is claimed is:

1. A support for holding the tie back and return of a drapery in relationship to a wall or other structure, the drapery hanging down along the wall in vertically extending folds with the return projecting toward the wall, the support comprising the combination of a base having a mounting flange at its proximal end for mounting the base to project generally perpendicular from the wall or structure adjacent one side of the return, an extension arm having a distal end for supporting a portion of the tie back and return, a plurality of parallel vertically spaced grooves formed along one surface of the base or arm, a plurality of parallel vertically spaced ribs formed along one surface of the respective arm or base, said ribs being sized for cooperative seating engagement in one mode of assembly in the grooves with the longitudinal axis of the arm projecting in horizontal alignment with the longitudinal axis of the base, or in an alternate mode with the longitudinal axis of the arm offset vertically from the longitudinal axis of the base, a plurality of parallel vertically spaced slots formed in the base or arm, a plurality of openings formed through the respective arm or base with the openings being in register with the slots in both of said modes, and fastener means extending through the grooves and openings with the fastener means adjustable for loosely supporting the arm on the base to permit relative sliding adjustment therebetween, and the fastener means further being adjustable for rigidly holding the arm on the base at a position where the drapery return is supported at a selected distance from the wall or structure.

* * * * *